US006598322B2

(12) United States Patent
Jacques et al.

(10) Patent No.: US 6,598,322 B2
(45) Date of Patent: Jul. 29, 2003

(54) SHOE WITH QUICK TIGHTENING UPPER

(75) Inventors: Robert N. Jacques, Andover, MA (US); Marco Giovanardi, Melrose, MA (US); Huckleberry B. Dorn, Boston, MA (US)

(73) Assignee: Cymer, Inc., San Diego, CA (US)

( * ) Notice: Subject to any disclaimer, the term of this patent is extended or adjusted under 35 U.S.C. 154(b) by 0 days.

(21) Appl. No.: 10/042,851

(22) Filed: Jan. 9, 2002

(65) Prior Publication Data

US 2002/0100188 A1 Aug. 1, 2002

Related U.S. Application Data

(60) Provisional application No. 60/261,379, filed on Jan. 12, 2001.

(51) Int. Cl.[7] ..... A43C 11/00; A43B 5/04

(52) U.S. Cl. ..... 36/50.1; 36/50.5; 36/138; 36/127

(58) Field of Search ..... 36/50.1, 50.5, 36/127, 138, 1, 117.6

(56) References Cited

U.S. PATENT DOCUMENTS 5,839,210 A * 11/1998 Bernier et al. ..... 36/50.1
6,032,387 A * 3/2000 Johnson ..... 36/50.1

FOREIGN PATENT DOCUMENTS

FR 2591882 * 6/1987

* cited by examiner

*Primary Examiner*—Ted Kavanaugh
(74) *Attorney, Agent, or Firm*—William Cray

(57) ABSTRACT

A shoe having at least one elongated shape memory alloy element and an electric circuit which when energized will produce a tightening of the shoe upper around the foot of a wearer. In a preferred embodiment, the shoe in one of a pair of golf shoes and the circuit in the shoe is energized by a switch in the heel that is turned on by the golfer clicking his heels together. Typically the golfer does this prior to each important swing of a golf club. A battery contained in the shoe provides a power source to produce a current in the circuit that heats the shape memory alloy causing it to reduce its length providing the tightening of the shoe uppers.

12 Claims, 2 Drawing Sheets

SHOE WITH QUICK TIGHTENING UPPER

RELATED APPLICATIONS

This application claims the benefit of U.S. Application No. 60/261,379 filed on Jan. 12, 2001, the disclosure of which is hereby incorporated by reference.

FIELD OF THE INVENTION

The invention relates generally to devices for, and methods of tightening or loosening the tension in footwear.

BACKGROUND OF THE INVENTION

During normal use of a shoe, there are long periods where it is desirable that the pressure or tension applied to the foot is soft and comfortable or loose, interrupted by short periods when it needs to feel tight to give the foot good stability. The term "shoe" in the specification and the claims shall refer to any type of footwear having a sole and a relatively flexible upper. Alternatively tightening and loosening the laces of the shoe can achieve alternative modes of a tight versus a loose fit of the shoe. Normally, a person would want to tighten his or her shoes only once, and not have to re-tighten or loosen them later. Further, individuals who prefer a tight fitting shoe often have to re-tighten the laces of their shoes several times as the laces naturally loosen with use over time.

By way of a specific footwear example, golf shoes must perform two separate and sometimes conflicting functions. One is to comfortably support the golfer's feet while walking on any kind of terrain, while the other function is to provide the golfer with the necessary foot stability during a swing. Between swings, many players would prefer that their laces were loosely tensioned to allow a comfortable fit. During the swing, however, tightly tensioned laces are desired to reduce foot movement in the shoe and give the foot stability. One way this could be achieved is to tighten and loosen the laces repeatedly. Yet most golfers prefer to tighten their shoes only once, and not have to adjust them before or after swings.

Downhill snow skiers typically want their boots tight for the downhill run which may last only a few minutes (or for some skiers a few seconds); then they must line up for the chair lift for several minutes. What is needed is a shoe with an upper which can be quickly tightened around the wearer's foot for short time periods without the need for manual tightening of laces or similar devices.

SUMMARY OF THE INVENTION

The present invention provides a shoe having at least one elongated shape memory alloy element and an electric circuit which when energized will produce a tightening of the shoe upper around the foot of a wearer. In a preferred embodiment, the shoe in one of a pair of golf shoes and the circuit in the shoe is energized by a switch in the heel that is turned on by the golfer clicking his heels together. Typically the golfer does this prior to each important swing of a golf club. A battery contained in the shoe provides a power source to produce a current in the circuit that heats the shape memory alloy causing it to reduce its length providing the tightening of the shoe uppers.

DETAILED DESCRIPTION

The present invention provides a shoe with an active tensioning system increasing the hold on the foot at specified times, while leaving it more relaxed at other (e.g. walking) times. For example, empirical data suggests that the difference between tight and loose shoelaces in a golf shoe can be achieved by decreasing the lace length approximately 5.0 mm. If the eyelets could be moved this distance away from each other, then the effect would be the same as tightening the laces themselves, because it would decrease the space the user's foot could occupy, increasing the pressure on the foot and create a tight fit. In a preferred embodiment, eyelets and laces are used to apply tension to a leather upper of a shoe and a shape memory alloy material in the form of wires attached to the eyelets of a shoe to modify the tension the leather upper applies to the foot.

Figure 1:
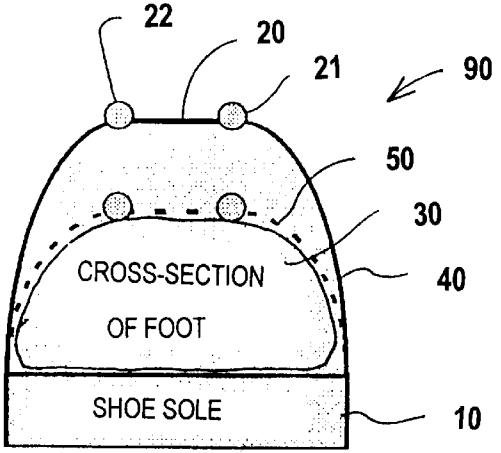
FIG. 1 is a schematic illustration in which the tension applied by a shoe on a foot is increased.

FIG. 1 illustrates an exaggerated movement of a leather upper of a shoe that increases the pressure applied to the foot. In this embodiment, laces 20 are used to partially constrain a foot 30 within a shoe 90. A leather upper 40 and sole 10 are further used to constrain the foot 30. The laces 20 span the shoe 90 between two depicted eyelets 21 and 22. While a means for affecting a change in the pressure applied to the foot 30 is not illustrated here, the effect of increasing the tension of the leather upper 40 on the foot 30 would have the effect of changing the position of the leather upper 40 to a new position of leather upper 50.

Figure 2:
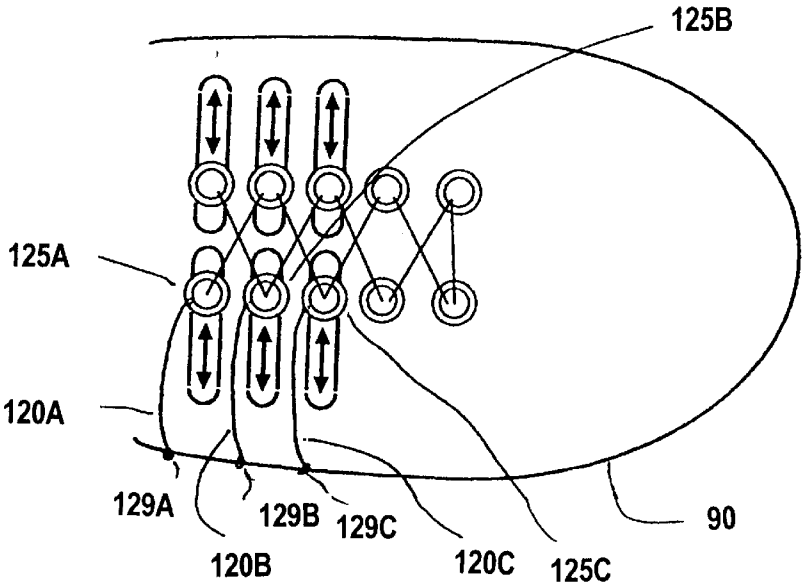
FIG. 2 illustrates a shoe with eyelets for attaching laces in which the eyelets are able to slide.

FIG. 2 illustrates a means by which the eyelets of a shoe would be capable of sliding as the length of shape memory alloy (SMA) wires are shortened. In this embodiment shape memory alloy wires 120 A, B, and C are shortened as a result of an electrical current applied to the wires. The electrical current applied to the wires causes the temperature of the wires to increase. At a pre-defined temperature the material comprising the wire changes its physical state and as a result contracts in length. As the wires 120 A, B, and C contract, eyelets 125 A, B, and C would slide towards wire anchor points 129 A, B, and C attached to the shoe sole 10.

Because maximum repeatable strain with SMA wires is approximately 3–4%, to obtain a change in length of 2.54 mm at the ends, the wire has to be approximately 75 mm in length. This is the approximate distance between the eyelets and soles of normal sized shoes. In a prototype demonstration of the present invention, Applicants empirically determined that the force required to tighten laces is approximately 13.4–22.24 N for each lace. A shape memory alloy wire of diameter 0.381 mm is capable of pulling with approximately 20.02 N and requires approximately 2A current (at approximately 1.3–1.7 V) such that the shape memory alloy material can be heated past its transformation temperature, and decrease in length by about 3–4 percent. The total energy required per contraction is $E=I*V*t*n$, where I is the current, V is the voltage per wire, t is the time for contraction, and n is the number of wires. Assuming six wires each with a diameter of 0.381 mm, the energy required is $(2A*1.3V*1sec*6)=15.6$ Joules. A AA battery is capable of providing 1,300 mAh at about 1.4V, which is about 6500 Joules of energy, which allows for more than 400 operations per battery charge. Using more than one battery per shoe will increase the number of operations proportionately. Manufacturing variations in the SMA wire or in battery performance also will affect performance (power consumption, longevity, etc.) of the system. After removal of the electrical current the SMA wires cool and relax. Then with a small mechanical return force, produced by normal movement of the foot, the wires return to their extended length state.

Figure 3:
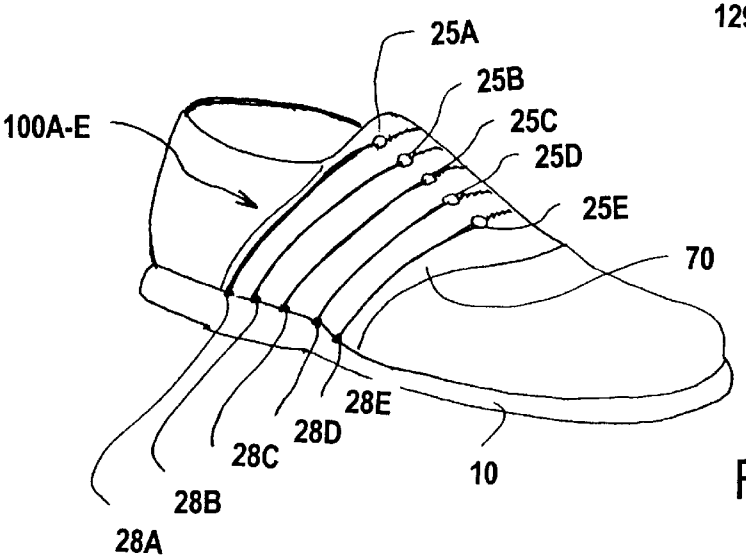
FIG. 3 depicts a shoe with shape memory alloy wires illustrated for tensioning the shoe.

FIG. 3 illustrates a means by which the position of a leather upper 70 could be altered to increase pressure on a foot. In this embodiment, the leather in the upper is a soft leather easily stretchable by about 4–5 percent. In this depiction, shape memory alloy wires 100 A, B, C, D, and E are attached to eyelets 25 A, B, C, D, and E, respectively and the sole 10 of the shoe in positions 28 A, B, C, D, and E, respectively. By way of example, shape memory alloy wire 100A might be 88.9 mm length, 0.381 mm diameter with pre-attached crimp connections and electrical leads as supplied by Dynalloy Inc. located in Costa Mesa, Calif. As electrical current is applied to each of wires 100 A, B, C, D, and E the length of the wires will decrease. As the wires 100 A, B, C, D, and E shorten, the leather upper 70 will apply an increasing pressure on the foot within the shoe.

Figure 4:
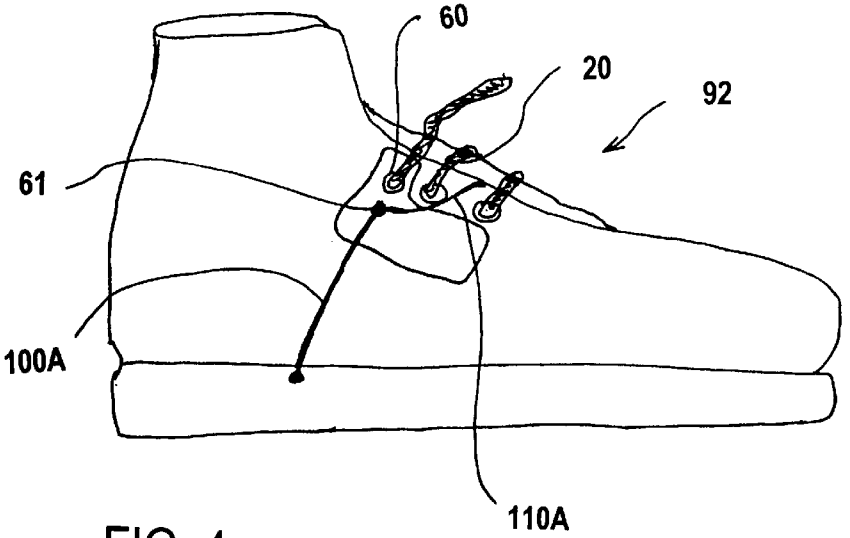
FIG. 4 illustrates a close-up of a shape memory alloy wire system for tensioning a shoe.

FIG. 4 illustrates an exemplary construction of the invention in which a lace 20 extends through a brass grommet 60 of ski boot 92. By way of example, grommet 60 might be a brass washer grommet 4.76 mm hole, standard trade size 00, part number 9604 K21 as available from McMaster-Carr Supply Company located in Atlanta, Ga. A shape memory alloy wire 100A is attached to the brass grommet 60 by means of crimped connection 61. The opposite end of wire 100A is attached to the sole of boot 92. Further, an electrical connection to one end of shape memory alloy wire 110A is shown. An additional electrical connection is made at the opposite end of the wire 100A to allow for an electrical current to be applied to the wire 100A to increase the temperature of the wire thereby decreasing the length of the wire 100A.

Figure 5:
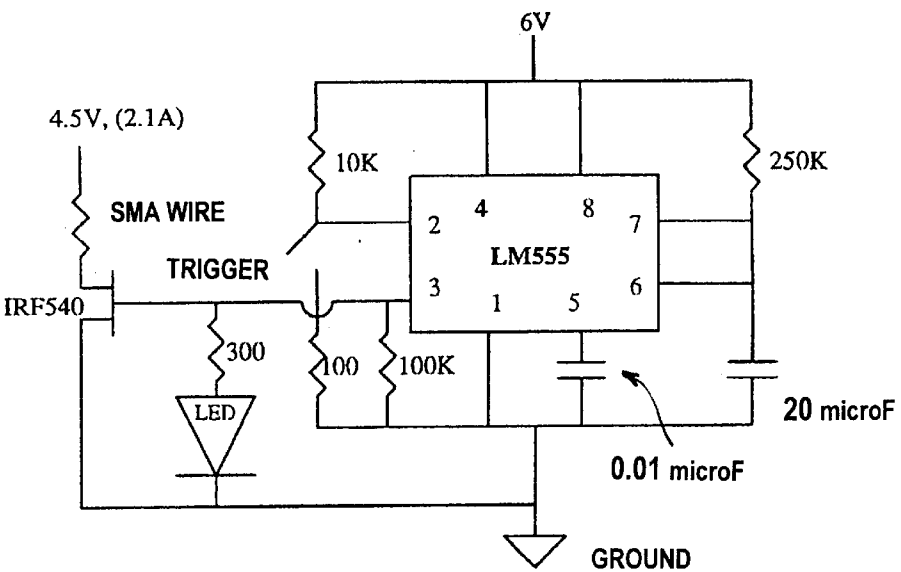
FIG. 5 illustrates an electrical timing circuit capable of providing the tensioning system with an electrical signal to control the tension of the shape memory alloy wires.

FIG. 5 illustrates a circuit design capable of altering and controlling the current flow applied to a shape memory alloy wire. An LM555 standard IC timer chip is utilized to control the duration that current flow is applied to the shape memory alloy wires. In this embodiment, a common resistive potentiometer was used to alter the duration of the current flow. For evaluation purposes a time of 1.5 seconds of current flow was determined to be sufficient to allow the wires to heat sufficiently to fully contract in length. The duration of current flow could be reduced to minimize power consumption. An IRF540 MOSFET IC device was used as a switch to turn the flow of current to the shape memory alloy wires on and off alternatively.

A system could be designed, for example, to automatically detect that the user was about to take a swing with a golf club and thereby increase the tension in the shoe. Preferably, however, a push-button switch mounted on the shoe is employed to allow the user to manually activate the system. For ease of use the switch could be mounted to the outside heel of the shoe. The user could activate the system by touching the switch with a golf club or his other shoe, thereby depressing the switch. Alternatively, the switch could be mounted on the inside of the heel, allowing the user to click the heels of the shoes together to initiate tightening. A final embodiment of the invention could involve integration of the battery and electronic circuit into the heel of the shoe.

EQUIVALENTS

While the invention has been particularly shown and described with reference to specific preferred embodiments, it should be understood by those skilled in the art that various changes in form and detail may be made therein without departing from the spirit and scope of the invention. There are many applications of the present invention other than for golf shoes and ski boots. For example, the described invention would also have general applicability to other forms of athletic footwear including: snowboard boots, rock climbing shoes, hiking boots, football shoes, gym shoes, and cross trainer shoes. Therefore, the scope of the invention should be determined by the attached claims and their legal equivalents.

We claim:

1. A shoe comprising:

A) a shoe upper,

B) a shoe sole,

C) at least one elongated shape memory alloy element attached to said shoe said element defining a threshold temperature at which a change in length of the element takes place, D) an electric circuit and a power source for applying an electric current to said at least one elongated shape memory alloy element to cause it to increase in temperature beyond said threshold temperature, and E) a switch for energizing said circuit to cause heating of said element and a tension to be applied in said shoe upper to cause a tightening of said upper around a wearer's foot.

2. A shoe as in claim 1 wherein said at least one shape memory alloy element is a plurality of shape memory alloy wires.

3. A shoe as in claim 2 wherein each of said plurality of wires are attached to one end to eyelets of said shoe and at another end to said sole.

4. A shoe as in claim 3 wherein each of said eyelets are configured to slide in a track located in said upper.

5. A shoe as in claim 1 and further comprising a timer for controlling duration of current flow through said shape memory alloy.

6. A shoe as in claim 1 wherein said shoe is a golf shoe.

7. A shoe as in claim 2 wherein said shoe is a golf shoe.

8. A shoe as in claim 1 wherein said shoe is a ski boot.

9. A shoe as in claim 2 wherein said shoe is a ski boot.

10. A shoe as in claim 1 wherein said shoe is a snowboard boot.

11. A shoe as in claim 1 wherein said shoe is a hiking boot.

12. A shoe as in claim 1 wherein said shoe is a gym shoe.

* * * * *